US006032681A

United States Patent [19]

Byun

[11] Patent Number: 6,032,681

[45] Date of Patent: Mar. 7, 2000

[54] COMPACT AND METHOD OF PRODUCING SUCH

[76] Inventor: Jung Ran Byun, 104-404 Daerim APT, 532 Yunsoo-dong, Yunsoo-ku, Inchon-shi, 406-110, Rep. of Korea

[21] Appl. No.: 09/252,868

[22] Filed: Feb. 17, 1999

[30] Foreign Application Priority Data

Feb. 20, 1998 [KR] Rep. of Korea ..... 98-5320

[51] Int. Cl.[7] ..... A45D 33/00

[52] U.S. Cl. ..... 132/293; 132/315; 220/839; 206/581

[58] Field of Search ..... 132/293, 294, 132/295, 300, 305, 306, 315, 317; 220/4.26, 626, 819, 837, 839; 206/581, 823

[56] References Cited

U.S. PATENT DOCUMENTS

| | | | |
|---|---|---|---|
| 1,524,559 | 1/1925 | Kline | 132/306 |
| 2,215,480 | 9/1940 | Sampson | 132/293 |
| 2,628,625 | 2/1953 | Pike | 132/293 |
| 3,037,616 | 6/1962 | Phipps, III | 220/839 |
| 4,096,986 | 6/1978 | Florian | 220/839 |
| 4,231,474 | 11/1980 | Takahashi | 220/839 |
| 5,121,834 | 6/1992 | Tissembaum | 220/839 |
| 5,348,031 | 9/1994 | Cloud | 206/581 |
| 5,429,240 | 7/1995 | Biebel et al. | 220/819 |
| 5,871,097 | 2/1999 | Shida et al. | 220/839 |

*Primary Examiner*—Jeffrey A. Smith
*Assistant Examiner*—Pedro Philogene
*Attorney, Agent, or Firm*—Cooper & Dunham LLP

[57] ABSTRACT

A compact or a small flat case, containing cosmetics such as women's face powder is disclosed. The compact has a case body produced from a foaming synthetic resin flat material having a high density, a board with at least one reservoir and a lock. The case body has lower and upper plates, having the same profile, and a connecting wall formed at the junction between the two plates in such a manner that the case body is slightly cut to a predetermined depth along two parallel and longitudinal cutting lines at its central portion, thus forming two hinge parts at positions around the cutting lines. The board with at least one reservoir is attached to an upper surface of the lower plate and is produced from a foaming synthetic resin material having a low density. The lock is mounted to between the free end of the upper plate and the free end of the lower plate, thus allowing the upper plate to be easily opened or closed.

2 Claims, 3 Drawing Sheets

COMPACT AND METHOD OF PRODUCING SUCH

BACKGROUND OF THE INVENTION

1. Field of the Invention

The present invention relates, in general, to compacts or small flat cases containing cosmetics such as women's face powder and, more particularly, to a compact directly produced from a synthetic resin flat material such as PVC or PP flat material, thus being easily and simply produced at low cost without preparing any molds and having a good and compact appearance. The present invention is also related to a method of producing such a compact.

2. Description of the Prior Art

As well known to those skilled in the art, a typical compact, containing a make-up material, has a fixed shape. Such a compact is typically produced from a moldable material, such as synthetic resin, through an injection molding process.

However, the above-mentioned compact has a problem. That is, molds with special constructions have to be prepared for the injection molding process, so the process of producing the compacts is complicated and this results in labor time consumption while manufacturing the compacts, thus reducing work efficiency and increasing production cost.

SUMMARY OF THE INVENTION

Accordingly, the present invention has been made keeping in mind the above problems occurring in the prior art, and an object of the present invention is to provide a compact capable of being directly produced from a synthetic resin flat material, thus being easily and simply produced at low cost without preparing any molds and having a good and compact appearance.

Another object of the present invention is to provide a method of producing such a compact.

In order to accomplish the above object, the present invention provides a compact, comprising: a case body produced from a foaming synthetic resin flat material having a high density and a constant thickness, the case body comprising lower and upper plates, having the same profile, and a connecting wall formed at the junction between the two plates in such a manner that the case body is slightly cut to a predetermined depth along two parallel and longitudinal cutting lines at its central portion, thus forming two hinge parts at positions around the cutting lines; a board with at least one reservoir attached to an upper surface of the lower plate, the board being produced from a foaming synthetic resin material having a low density; and locking means mounted to between the free end of the upper plate and the free end of the lower plate, thus allowing the upper plate to be easily opened or closed.

Also, the present invention provides a method for producing a compact, comprising the steps of: preparing a flat plate member from a foaming synthetic resin material, the plate member having a high density and a constant thickness; forming a case body from the flat plate member through a cutting process, the case body comprising lower and upper plates and a connecting wall formed at the function between the two plates in such a manner that the case body is slightly cut to a predetermined depth along two parallel and longitudinal cutting lines at its central portion, thus forming two hinge parts at positions around the cutting lines; attaching a board with at least one reservoir to an upper surface of the lower plate, the board being produced from a foaming synthetic resin material having a low density; and mounting locking means to between the free end of the upper plate and the free end of the lower plates so as to allow the upper plate to be easily opened or closed.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
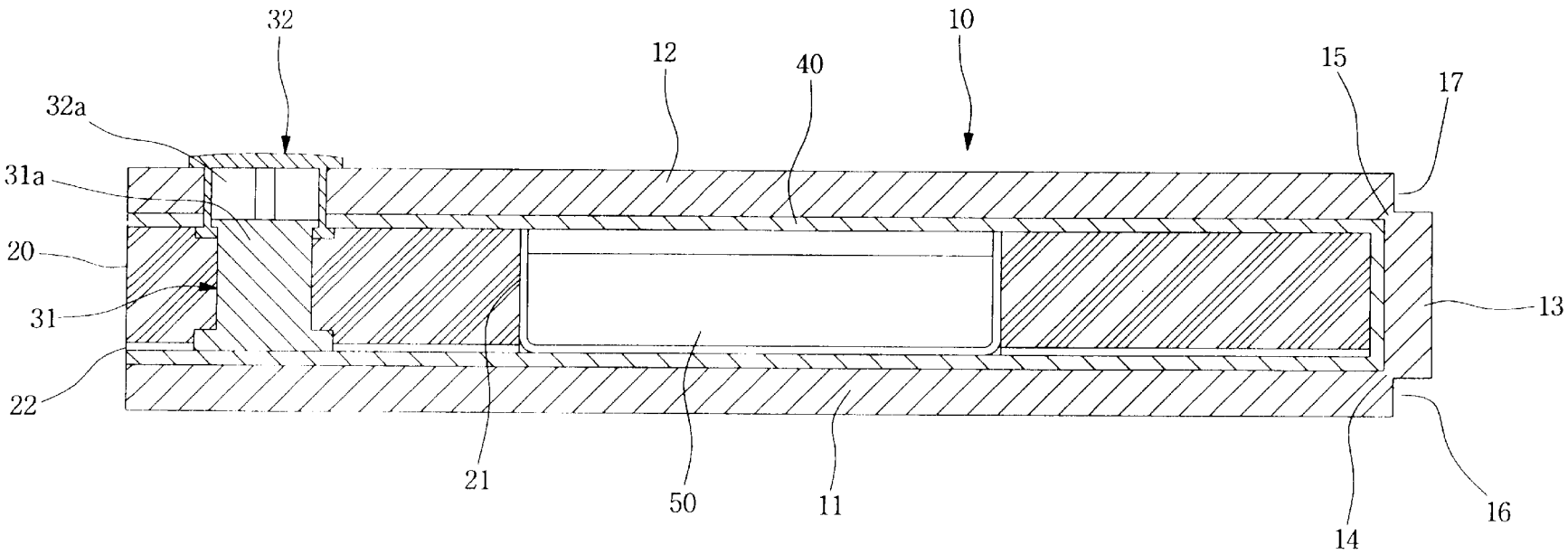
FIG. 1 is a cross-sectional view of a compact in accordance with the preferred embodiment of the present invention.

FIGS. 1 and 2, are views illustrating the construction of a compact in accordance with the preferred embodiment of the present invention.

As shown in the drawings, the compact comprises a case body 10 produced from a synthetic resin flat material. The case body 10 includes lower and upper plates 11 and 12, and a connecting wall 13 formed at the junction between the two plates 11 and 12. That is, the central portion of the case body 10 is slightly cut to a predetermined depth along two parallel and longitudinal cutting lines 16 and 17, thus forming two hinge parts 14 and 15 at positions around the cutting lines 16 and 17 (see FIG. 2B). Each of the two hinge parts 14 and 15 comprises a flexible wall which has a thickness less than the that of the connecting wall 13. The connecting wall 13 is perpendicularly bent from the lower plate 11, while the upper plate 12 is downwardly and perpendicularly bent from the connecting wall 13. Therefore, the two plates 11 and 12, having the same profile, are connected to each other by the connecting wall 13.

Figure 2A:
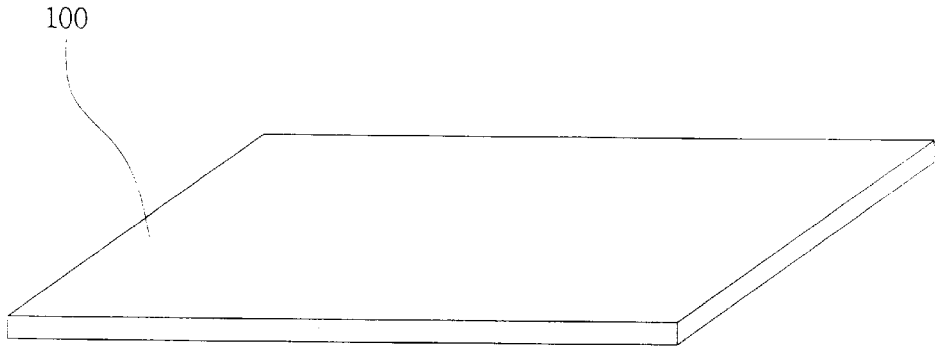
FIGS. 2A to 2D are views showing the steps of producing the compact in accordance with this invention.
Figure 2B:
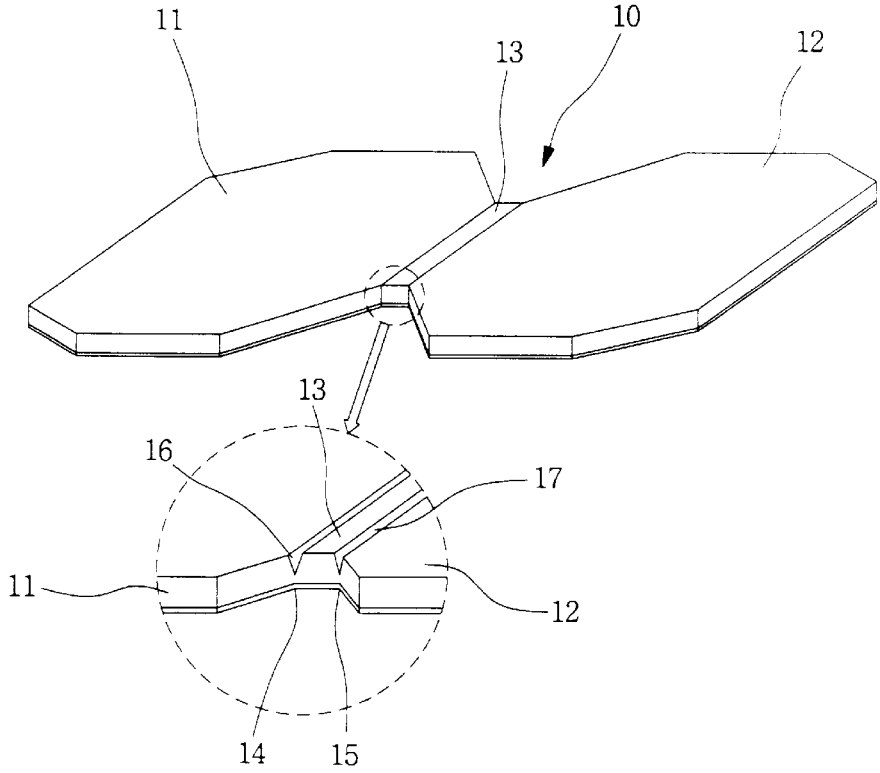
Figure 2C:
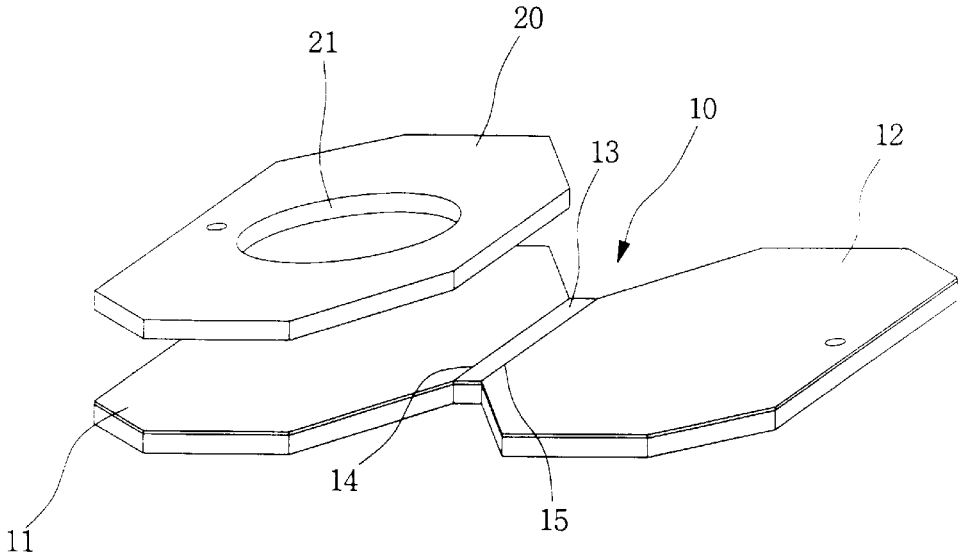
Figure 2D:
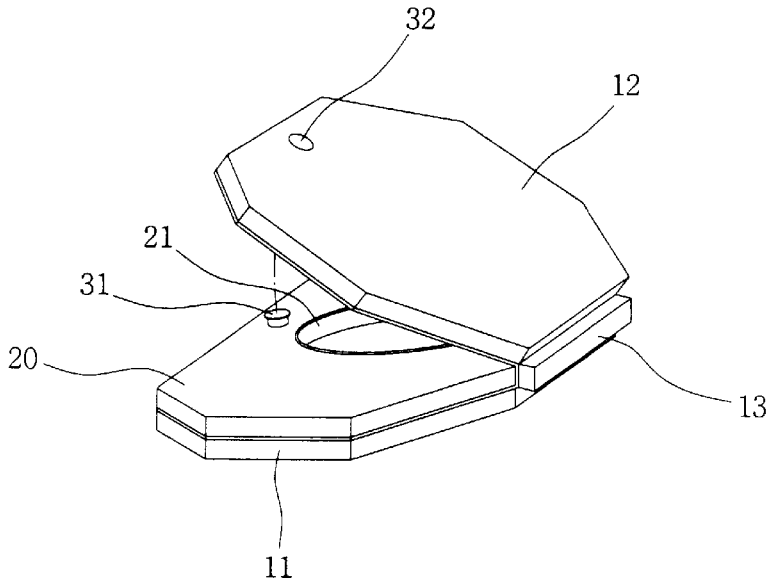

A board 20, provided with at least one reservoir 21 adapt for receiving a make-up material at its central portion, is adhered to the top portion of the lower plate 11. In addition, a locking means is mounted between the free end of the lower plate 11 and the free end of the upper plate 12. That is, such a locking means comprises a locking hole 32 formed on the free end of the upper plate 12 and a protrusion 31 adhered to the top surface of the lower plate 11 at a position opposite to the locking hole 32 as best seen in FIG. 2D. In such a case, one end of the protrusion 31 is fixed to the lower plate 11, while the other end of the protrusion 31, having a diameter larger than that of the locking hole 32, is elastically inserted into and separated from the locking hole 32.

The case body 10, including the connecting wall 13 and the two plates 11 and 12, is preferably produced from a foaming PVC (polyvinyl chloride) or PP (polypropylene) flat material having a high density. As a result, the compact has a good and compact appearance, improved durability and impact resistance as compared with a typical compact.

The board 20 is preferably produced from chemically cross-linked polyolefin material, such as a foaming sponge having a low density. In addition, the bottom surface of the board 20 is provided with an adhesive layer 22, while a removable backing paper is adhered to the adhesive layer 22. Therefore, the removable backing paper is removed from the adhesive layer 22 prior to adhering the board 20 to the lower plate 11. The above adhesive layer 22 is formed of typical or acrylic adhesive material.

FIGS. 2A to 2D are views showing the steps of producing the compact in accordance with this invention.

As shown in FIG. 2, the present invention provides a method for producing a compact, comprising the steps of: preparing a flat plate member from a foaming synthetic resin material, the plate member having a high density and a constant thickness; forming a case body from the flat plate member through a cutting process, the case body comprising lower and upper plates and a connecting wall formed at the junction between the two plates in such a manner that the case body is slightly cut to a predetermined depth along two parallel and longitudinal cutting lines at its central portion, thus forming two hinge parts at positions around the cutting lines; attaching a board with at least one reservoir to an upper surface of the lower plate, the board being produced from a foaming synthetic resin material having a low density; and mounting locking means to between the free end of the upper plate and the free end of the lower plates so as to allow the upper plate to be easily opened or closed.

In a detailed description, the case body 10 is produced from the flat plate member 100. That is, the flat plate member 100 is partially cut into a desired configuration of the case body 10 through a typical pressing process. Also, the two plates 11 and 12, the connecting wall 13 and the hinge parts 14 and 15 are formed during the above pressing process.

In order to form the hinge parts 14 and 15, the central portion of the case body 10 is slightly cut to a predetermined depth along two parallel and longitudinal cutting lines 16 and 17 by a press device with two cutting blades during the pressing process.

In the preferred embodiment of this invention, the hinge parts 14 and 15 are easily formed by means of the two cutting blades which are quickly heated to at least 100° C. using a radio heating means. Thus, the hinge parts 14 and 15 are firmly integrated with the case body 10. Furthermore, a soft film layer 40, produced from a PVC material, is attached to the inner surface of the case body 10, so the two plates 11 and 12 are not unexpectedly separated from the connecting wall 13 and can be easily folded, respectively.

In addition, the reservoir 21 of the board 20, adhered to the lower plate 11, can be easily closed and opened by the upper plate 12. The protrusion 31, fixed to the lower plate 11, is elastically inserted into the locking hole 32 of the upper plate 12, thus causing the upper plate 12 to be brought into contact with the board 20 and allowing the compact to be easily kept by a user.

As mentioned above, the compact of this invention has a configuration capable of being directly produced from a synthetic resin flat material, thus being easily and simply produced at low cost without preparing any molds and having a good and compact appearance and practicality. Also, the compact of this invention is light, nontoxic and reusable. Of course, the method for manufacturing the compact according to this invention may be adapted to manufacture various file covers or cases, toy cases, cases for keeping small pieces and dye cases, etc.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A, compact comprising:

a case body produced from a flat foaming synthetic resin material having a high density and a constant thickness, said case body comprising lower and upper plates, having the same profile, and a connecting wall formed at a junction between the two plates in such a manner that said case body is slightly cut to a predetermined depth along two parallel and longitudinal cutting lines at a central portion of said case body, thus forming two hinge parts at positions around the cutting lines;

a board with at least one reservoir attached to an upper surface of said lower plate, said board being produced from a foaming synthetic resin material having a low density; and locking means mounted to between the free end of said upper plate and the free end of said lower plate, thus allowing said upper plate to be easily opened and closed.

2. A method for producing a compact, comprising the steps of:

preparing a flat plate member from a foaming synthetic resin material, said plate member having a high density and a constant thickness;

forming a case body from said flat plate member through a cutting process, said case body comprising lower and upper plates and a connecting wall formed at a junction between the two plates in such a manner that said case body is slightly cut to a predetermined depth along two parallel and longitudinal cutting lines at a central portion of said case body, thus forming two hinge parts at positions around the cutting lines;

attaching a board with at least one reservoir to an upper surface of said lower plate, said board being produced from a foaming synthetic resin material having a low density; and mounting locking means to between the free end of said upper plate and the free end of said lower plates so as to allow said upper plate to be easily opened and closed.

* * * * *